US007246395B2

(12) United States Patent
Buckroyd et al.

(10) Patent No.: US 7,246,395 B2
(45) Date of Patent: Jul. 24, 2007

(54) WASHER/DRYER GRAPHICAL USER INTERFACE

(75) Inventors: James David Buckroyd, Louisville, KY (US); Derek Lee Watkins, Elizabethtown, KY (US); William Henry Lueckenbach, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 489 days.

(21) Appl. No.: 10/248,003

(22) Filed: Dec. 9, 2002

(65) Prior Publication Data

US 2004/0107510 A1 Jun. 10, 2004

(51) Int. Cl.
*D06F 39/00* (2006.01)

(52) U.S. Cl. ..... 8/158; 68/12.27

(58) Field of Classification Search ..... 68/12.27
See application file for complete search history.

(56) References Cited

U.S. PATENT DOCUMENTS 3,508,340 A * 4/1970 Kombol ..... 34/553
4,676,077 A * 6/1987 Hirooka et al. ..... 68/12.27
4,763,493 A * 8/1988 Nishite et al. ..... 68/12.27
4,977,394 A * 12/1990 Manson et al. ..... 340/679
4,982,468 A * 1/1991 Takahashi et al. ..... 8/159
5,272,892 A * 12/1993 Janutka et al. ..... 68/12.02
5,279,134 A * 1/1994 Nonogaki et al. ..... 68/12.27
5,570,596 A * 11/1996 Imai et al. ..... 68/12.05
5,671,493 A * 9/1997 Moon ..... 8/159
5,694,793 A * 12/1997 Nishimura et al. ..... 68/12.27
6,029,298 A 2/2000 Dausch et al.
6,169,964 B1 * 1/2001 Aisa et al. ..... 702/136
6,502,265 B2 * 1/2003 Blair et al. ..... 8/159
6,550,290 B2 * 4/2003 Shimakage et al. ..... 68/12.04
6,553,595 B1 * 4/2003 Bruntz et al. ..... 8/158
6,626,013 B2 * 9/2003 Ohta et al. ..... 68/12.27
6,671,916 B2 * 1/2004 Herr et al. ..... 8/159
2002/0158910 A1 * 10/2002 Sharrow ..... 345/810
2003/0184597 A1 * 10/2003 Jo et al. ..... 345/810

FOREIGN PATENT DOCUMENTS

GB 2 001 454 * 1/1979
JP 61-146296 * 7/1986
JP 63-153093 * 6/1988
JP 1-124495 * 5/1989
JP 3-218795 * 9/1991
JP 5-345090 * 12/1993
JP 9-201485 * 8/1997
JP 9-313770 * 12/1997
JP 2001-293283 * 10/2001

OTHER PUBLICATIONS

European Patent Office 0 356 662 Mar. 1990.*

* cited by examiner

*Primary Examiner*—Frankie L. Stinson
(74) *Attorney, Agent, or Firm*—George L. Rideout, Esq.; Armstrong Teasdale LLP

(57) ABSTRACT

A control panel for a laundry appliance includes a cycle type section comprising a reconfigurable display, and a cycle parameter section graphically illustrating selected laundry cycle parameters.

16 Claims, 4 Drawing Sheets

WASHER/DRYER GRAPHICAL USER INTERFACE

BACKGROUND OF INVENTION

This invention relates generally to control systems for appliances, and more specifically, to user interfaces for clothes washers and dryers.

Laundry appliances (e.g., clothes washers and dryers) typically include a number of mechanical components housed in a cabinet to perform different aspects of clothes washing and clothes drying. See, for example, U.S. Pat. No. 6,029,298 describing a washing machine.

Conventionally, mechanical switches and actuators have been employed for user manipulation thereof to operate a clothes washer or dryer in selected settings and to activate or deactivate appliance features and options. Known electronic controls, however, have facilitated washer and dryer features and modes of operation not found in conventional mechanically controlled systems. For example, an increased number of washing cycles and associated options are now available in washing machines, and various drying cycles and features have also been developed to increase appliance performance and convenience. Known control interfaces to implement these features, however, tend to be cumbersome and difficult to new users, and tedious and time consuming for other users. Some washer and dryer operations and features require rather complex manipulation of a control interface that includes a large number of selectors for a large number of washing options, which can be overwhelming to new users and less than intuitive even to experienced users. Significant cognitive effort is therefore required to operate these machines.

SUMMARY OF INVENTION

In one aspect, a control panel for a laundry appliance is provided. The control panel comprises a cycle type section comprising a reconfigurable display, and a cycle parameter section graphically illustrating selected laundry cycle parameters.

In another aspect, a control system for a laundry appliance is provided. The control system includes a microcomputer, and a control panel coupled to said microcomputer for receiving user input of laundry cycle selections. The control panel comprises a cycle type section comprising a reconfigurable display, and a cycle parameter section comprising at least one graphical icon configured to change an appearance thereof, thereby indicating a setting of a laundry cycle parameter.

In another aspect, a laundry appliance is provided. The appliance comprises a cabinet comprising a backsplash, a microcomputer, and a control panel coupled to said microcomputer. The control panel comprises a reconfigurable display, a first set of input selectors associated with said reconfigurable display, and a plurality of graphical icons separate from said reconfigurable display. The graphical icons are configured to indicate selected laundry cycle parameters.

In still another aspect, a method of interfacing user input to a laundry appliance is provided. The appliance includes a microcomputer coupled to a control panel interface, and the control panel interface includes a reconfigurable display and a set of associated input selectors. The control panel also includes a set of wash cycle type input selectors, and a cycle parameter and options section including a plurality of segmented graphical icons. The method comprises displaying a menu selection screen on said reconfigurable display in response to actuation of at least one of the wash cycle type input selectors, accepting a selection from the menu selection screen in response to actuation of one of the input selectors associated with the reconfigurable display, and displaying selected parameter values corresponding to the menu selection in the graphical icons by changing an appearance of some of the icon segments.

DETAILED DESCRIPTION

Figure 1:
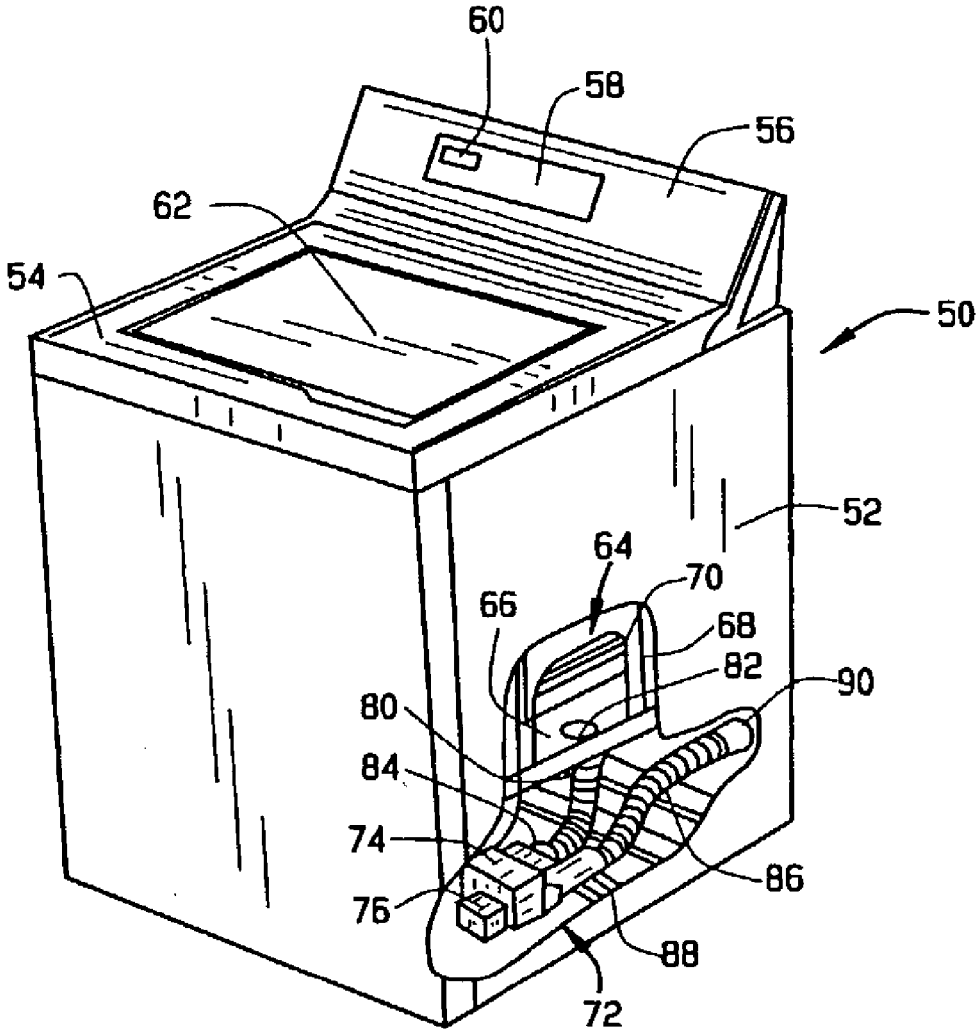
FIG. 1 is a perspective cutaway view of an exemplary washing machine appliance.

FIG. 1 is a perspective view partially broken away of an exemplary laundry appliance 10 in which the present invention may be practiced. While laundry appliance 10 in the illustrated embodiment is a washing machine, the control principles and associated advantages described below are equally applicable to other types of laundry appliances, including but not limited to other types of washing machines and clothes dryer machines. Therefore, the illustrated washing machine 10 is offered for illustrative purposes only and in no way is intended to limit the invention in any aspect.

Exemplary washing machine 10 includes a cabinet 52 and a cover 54. A backsplash 56 extends from cover 54, and a control interface 58 including at least one display 60 is coupled to backsplash 56. Timer mechanism 58 and input selectors 60 collectively form a user interface input for operator selection of machine cycles and features. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 10 is a vertical axis washing machine. It is contemplated however, that the benefits of the present invention are equally applicable to other types of washing machines, such as horizontal axis machines familiar to those in the art.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74, a motor 76, and in an exemplary embodiment a motor fan (not shown). A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
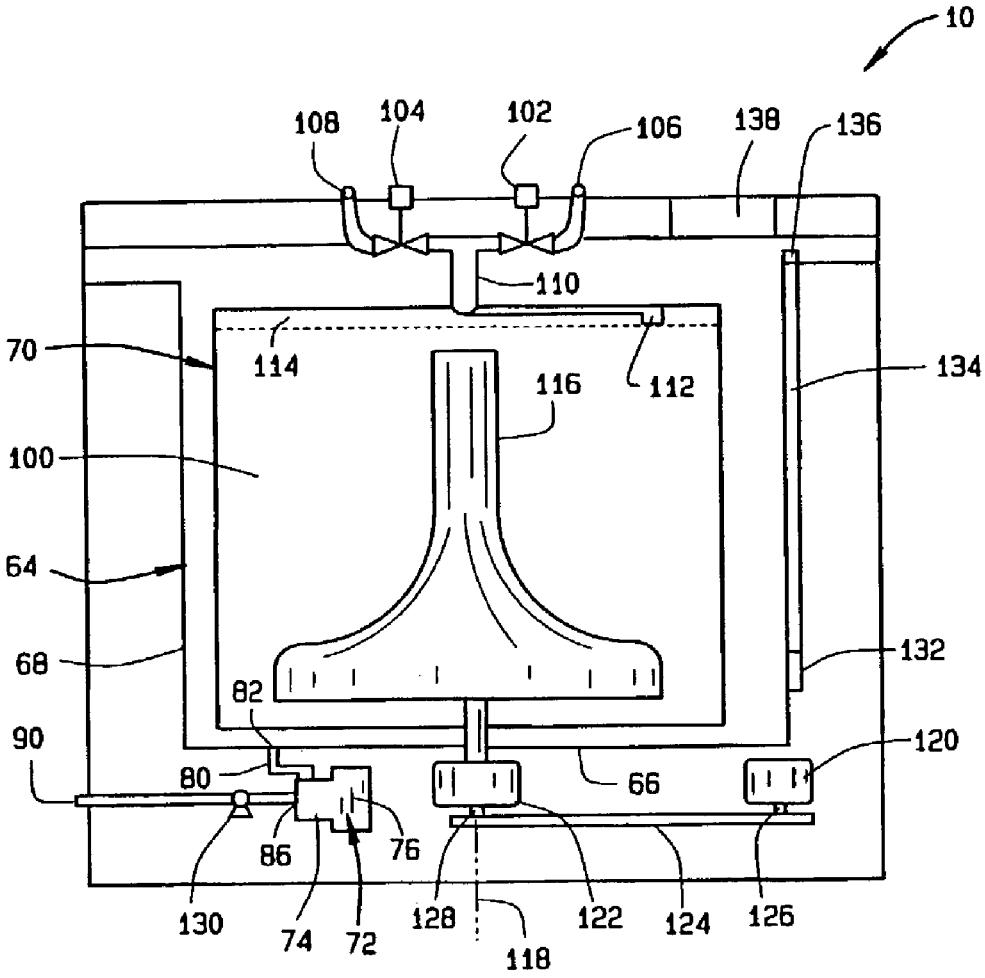
FIG. 2 is front elevational schematic view of the washing machine shown in FIG. 1.

FIG. 2 is a front elevational schematic view of washing machine 10 including wash basket 70 movably disposed and rotatably mounted in wash tub 64 in a spaced apart relationship from tub side wall 64 and tub bottom 66. Basket 12 includes a plurality of perforations therein to facilitate fluid communication between an interior 100 of basket 70 and wash tub 64.

A hot liquid valve 102 and a cold liquid valve 104 deliver fluid, such as water, to basket 70 and wash tub 64 through a respective; hot liquid hose 106 and a cold liquid hose 108. Liquid valves 102, 104 and liquid hoses 106, 108 together form a liquid supply connection for washing machine 10 and, when connected to a building plumbing system (not shown), provide a fresh water supply for use in washing machine 10. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing or articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitator, impeller, or oscillatory basket mechanism 116 is disposed in basket 70 to impart an oscillatory motion to articles and liquid in basket 70. As illustrated in FIG. 2, agitator 116 is oriented to rotate about a vertical axis 118. It is contemplated, however, that at least some of the benefits of the present invention may apply to horizontal axis washing machines as well.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitator 116 for rotatable movement within wash tub 64, and clutch system 122 facilitates relative rotation of basket 70 and agitator 116 for selected portions of wash cycles Motor 120, transmission and clutch system 122 and belt 124 collectively are referred herein as a machine drive system.

Washing machine 10 also includes a brake assembly (not shown) selectively applied or released for respectively maintaining basket 70 in a stationary position within tub 64 or for allowing basket 70 to spin within tub 64. Pump assembly 72 is selectively activated to remove liquid from basket 70 and tub 64 through drain outlet 90 and a drain valve 130 during appropriate points in washing cycles as machine 10 is used. In an exemplary embodiment, machine 10 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, voltage or current phase shifts, etc.

Operation of machine 10 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 10 to execute selected machine cycles and features.

In an illustrative embodiment, clothes are loaded into basket 70, and washing operation is initiated through operator manipulation of control interface 58 (shown in FIG. 1). Tub 64 is filled with water and mixed with detergent to form a wash fluid, and basket 70 is agitated with agitator 116 for cleansing of clothes in basket 70. After a predetermined period of agitation, tub 64 is drained with pump assembly 72.

Figure 3:
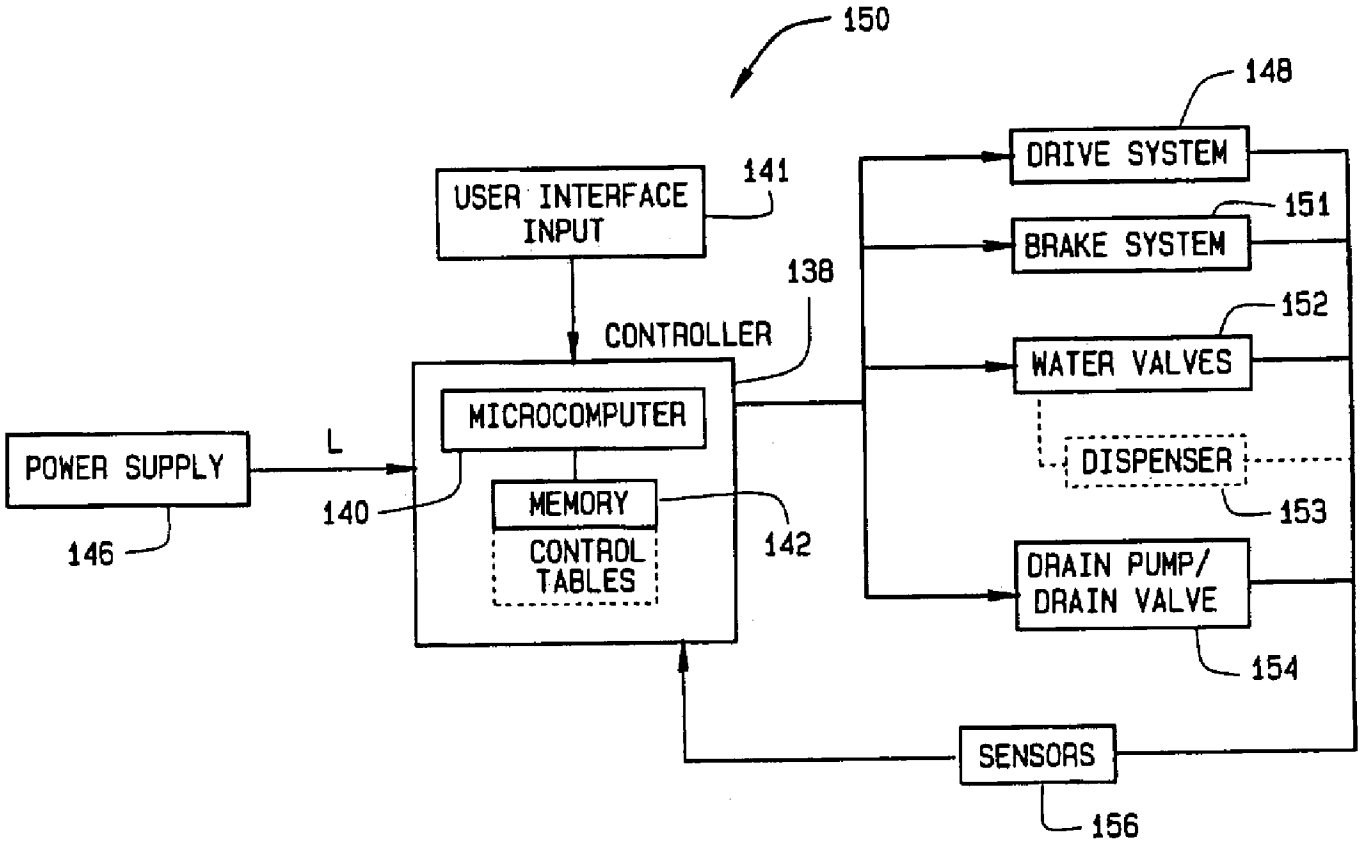
FIG. 3 is a schematic block diagram of a control system for the washing machine shown in FIGS. 1 and 2.

FIG. 3 is a schematic block diagram of an exemplary washing machine control system 150 for use with washing machine 10 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through control interface 58 (shown in FIG. 1). A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120 and clutch system 122 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70 (shown in FIG. 1).

In response to manipulation of user interface input 141 controller 138 monitors various operational factors of washing machine 10 with one or more sensors or transducers 156, and controller 138 executes operator selected functions and features according to known methods. Of course, controller 138 may be used to control washing machine system elements and to execute functions beyond those specifically described herein.

Figure 4:
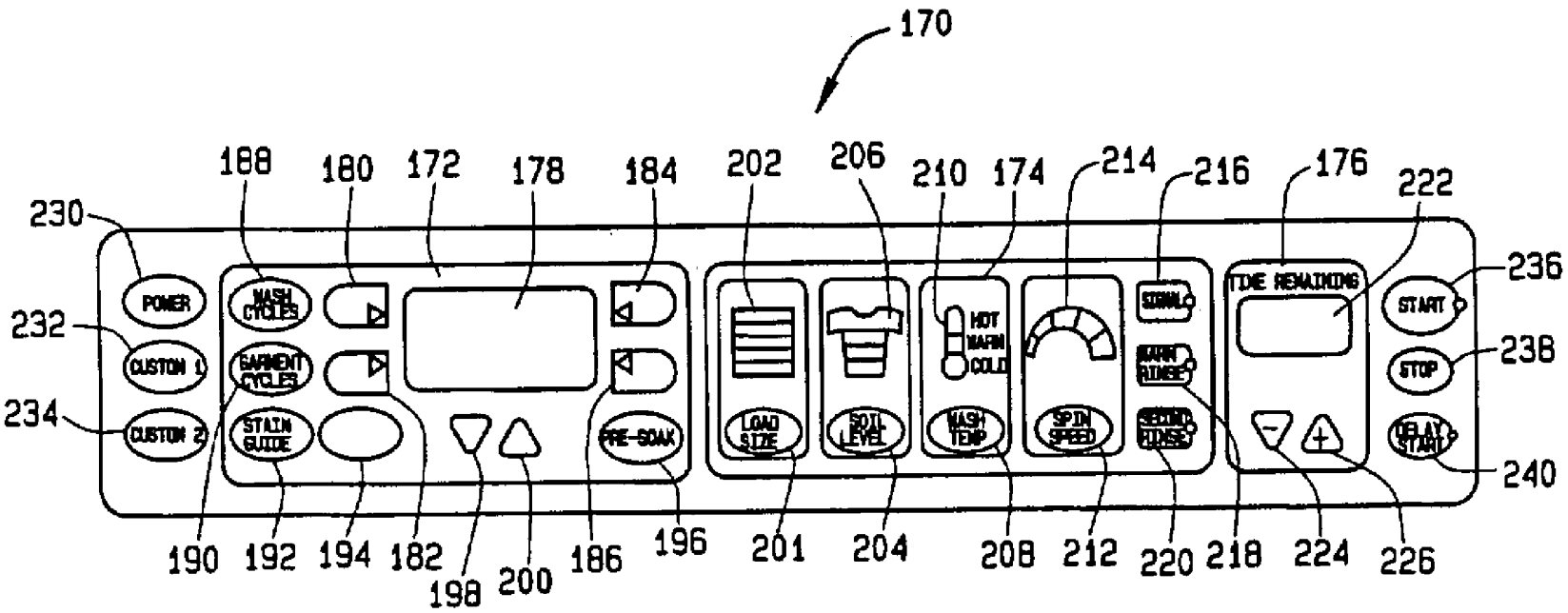
FIG. 4 is a top plan view of a graphical user interface for the washing machine shown in FIG. 1.

FIG. 4 is a top plan view of a graphical user interface input 141 in the form of an oven control interface panel 170 for interactive user selection of instructions for control system 150 (shown in FIG. 3). Control panel 170 includes three distinct sections including a wash cycle type section 172 wherein a user may select a wash cycle type (explained below), a wash cycle parameter and option section 174 wherein a user may adjust wash cycle parameters and activate/inactivate cycle options, and a time display region 176.

Wash cycle type section 172 includes a reconfigurable display 60. A set of input selectors is associated with reconfigurable display 60 and includes selectors 180, 182 arranged in a vertical column along a left side of reconfigurable display 60 and also selectors 184, 186 arranged in a vertical column along a right side of display 60. Each selector 180 through 186 corresponds to one of a plurality of options displayed on a menu in display 60, and by manipulating a specific one of selectors 180 through 186, the corresponding menu option is selected.

As used herein, display 60 is deemed reconfigurable in that message lines in display 60 adjacent respective input selectors 180 through 186 do not have a fixed configuration capable of displaying only a limited number of messages or indicators in designated locations in display 60, but rather are capable of generating a large variety of symbols, alphanumeric characters, and indicia across the various regions of display 60 to produce a given screen display. Additionally, one or more portions of display 60 may be rewritten by processor 140 (shown in FIG. 3) to produce a different screen display. Thus, unlike known light emitting diode (LED) and certain liquid crystal displays (LCD's) operable to display a limited number of preset indicators in predetermined locations, display 60 is capable of displaying messages and symbols of varying length and at different locations in display 60, and is also capable of displaying different messages and symbols in those same locations in display 60. In other words, display 60 is a graphic display screen capable of regenerating multiple and different text and symbol displays. Display screens capable of such image generation are known and include liquid crystal display (LCD), cathode ray tube (CRT), a plasma display, or the like which employ fragmented image generation, such as with pixels.

In an exemplary embodiment, wash cycle type input screens are presented on display 60 in response to operator manipulation of one or more of input selectors 188, 190, 192, 194, and 196 in control panel wash cycle type section 172. For example, selector 188 corresponds to WASH CYCLES, and when selector 188 is depressed, a variety of wash cycle choices appear on reconfigurable display 60 which a user may select by manipulating the appropriate selector 180, 182, 184, or 186 adjacent the desired choice in reconfigurable display 60. Likewise, selector 190 corresponds to GARMENT CYCLES, and when selector 190 is depressed, a variety of garment choices appear on reconfigurable display 60 which a user may select by manipulating the appropriate selector 180, 182, 184, or 186 adjacent the desired choice in reconfigurable display 60. Similarly, selector 192 corresponds to STAIN GUIDE, and when selector 192 is depressed, a variety of choices regarding different types of stains appear on reconfigurable display 60 which a user may select by manipulating the appropriate selector 180, 182, 184, or 186 adjacent the desired choice in reconfigurable display 60. Selector 194 corresponds to a SPEED WASH cycle, and selector 196 corresponds to a PRESOAK cycle, and each of selectors 194 and 196 may include associated menu screens on reconfigurable display 60.

For instance, if GARMENT CYCLES selector 190 is depressed in one embodiment, an option menu may appear on display 60 including a number of garment options, such as, for example, a JEANS option, a TOWELS option, a KNIT SHIRTS option and a MORE option. Each menu option is listed in display 60 adjacent one of input selectors 180-186. Thus, continuing with the foregoing example, assume that the JEANS option is listed alongside selector 180, the TOWELS option is listed alongside selector 182, the KNIT SHIRTS option is listed alongside selector 184, and the MORE option is listed alongside selector 186. When this menu screen is presented, pressing selector 180 selects a JEANS cycle, pressing selector 182 selects a TOWELS wash cycle, pressing selector 184 selects a KNIT SHIRTS wash cycle, and pressing selector 186 (the MORE option) results in another menu screen including an additional garment cycle selection menu.

In addition, navigation buttons 198, 200 are located beneath reconfigurable display 60 in control panel wash cycle type section 172. In an exemplary embodiment, navigation buttons 198, 200 are in the form of slew keys (i.e., up and down keys) and may be used to navigate between selection menus or to make additional menu selections.

Thus, wash cycle selection screens may be categorically presented on display 60 in response to user manipulation of selectors 188-196, and desired menu options may be selected with selectors 180-186 associated with display 186. Consequently, a rather large number of wash cycle inputs may be made with a rather small number of input selectors. Additionally, it is believed that control panel wash cycle type section 172 is intuitively used in a straightforward manner.

It is anticipated that control panel wash cycle type section 172 may include greater or fewer input selectors than illustrated in FIG. 4 to include accommodate a greater or fewer number of options for selecting cycle types. Further, it is contemplated that different functions may be assigned to the selectors shown in FIG. 4 without departing from the scope of the present invention.

Wash cycle parameter and option section 174 includes a plurality of input selectors and associated graphical displays to indicate wash cycle parameters and options selected, and to provide an opportunity for user adjustment of selected parameters and options.

In an illustrative embodiment, wash cycle parameter and option section 174 includes a LOAD SIZE selector 201 and an associated graphical icon 202, a SOIL LEVEL input selector 204 and an associated graphical icon 206, a WASH TEMP icon 208 and an associated graphical icon 210, and a SPIN SPEED input selector 212 and an associated graphical icon 214. Wash cycle parameter and option section further includes a SIGNAL input selector 216, a WARM RINSE input selector 218, and a SECOND RINSE input selector 220.

Graphical icons 202, 206, 210, and 214 assist in the selection process by indicating the associated wash cycle characteristic and an associated state of that characteristic. For example, and as illustrated in FIG. 4, load size icon 202 is in the form of a washer basket, the soil level icon 206 is in the form of a T-shirt, the wash temperature icon 210 is in the form of a thermometer, and the SPIN speed icon is in the form of a spiral shape. The icons are large and prominently displayed so that a cycle type selection may be made at a glance. It is contemplated that other graphical icons, shapes, and representations may be employed in alternative embodiments to accomplish similar objectives.

Additionally, in the illustrated embodiment, each icon 202, 206, 210, and 214 is segmented to indicate a current state of the associated wash cycle parameter. Thus, the load size basket icon 202 includes five segments in an exemplary embodiment to indicate one of five load size settings, T-shirt soil level icon includes four segments in an exemplary embodiment to indicate one of four soil level settings, thermometer wash temperature icon 214 includes three segments in an exemplary embodiment to indicate a wash temperature setting, and spiral spin seed icon 214 includes five segments to indicate one of five spin settings for a wash cycle. Of course, greater or fewer icon segments may be employed in alternative embodiments of the invention.

In an exemplary embodiment, the icon segments are changed in appearance as the associated input selectors are manipulated. Thus, for example, the lower two segments of the T-shirt soil level icon 204 may be highlighted to indicate a current soil level setting of two out of four settings. By depressing soil level indicator 204, the soil level parameter may be changed to the third setting and another segment illuminated to indicate the soil level on icon 206 with three highlighted icon segments. By depressing soil level indicator 204 again, the soil level parameter may be changed to the fourth setting and the final icon segment illuminated to indicate the soil level on icon 206.

In an alternative embodiment, actuation of input selectors 201, 204, 208 and 212 may prompt an associated menu selection screen on reconfigurable display 60, and desired settings may be selected with input selectors 180-186 and/or selectors 198 and 200 associated with display 176.

Control panel time display section 176 includes a time display 222 and associated up and down slew keys 224, 226 for adjusting a time displayed in display 222. A countdown timer, i.e., time remaining in the wash cycle, is implemented in display 222, which is large and prominent so that a user may see the time status of a wash cycle from across the room. Display 222 in an exemplary embodiment is an LED display, and unlike reconfigurable display 60, display 222 is a fixed display. That is, display 222 is capable of displaying limited information in predetermined locations in display 222.

Using control panel 170, a user may be efficiently guided through wash cycle selection and machine operation in a simple and direct manner with reduced cognitive effort in comparison to known washing machine control schemes. When a wash cycle type is selected via one of the selectors in wash cycle type section 172, pre-set parameters and settings associated with the selected wash cycle are displayed in control panel sections 174 and 176. By manipulating the input selectors in sections 174 and 176, pre-set cycle parameters may be changed or adjusted in an organized manner with the assistance of graphical icons. Thus, a user friendly system capable of accommodating expanded washing machine features is provided.

In addition to wash cycle type section 172, cycle parameter and option section 174, and time display section 176, control panel 170 further includes a power input selector 230, two custom cycle input selectors 232, 234 for creating and/or saving favorite washing cycles. Thus, user-created wash cycles may be conveniently stored and recalled with selectors 232, 234.

Control panel further includes a START selector 236, a STOP selector 238 and a DELAY START selector 240. Time display selectors 224, 226 may be used to select a delayed start time value.

In exemplary embodiments, the above-described input selectors of control panel 170 are known tactile switches including graphic overlays. It is appreciated that in alternative embodiments other known switch assemblies may be employed, including but not limited to capacitive glass touch assemblies or touch sensitive membrane switch assemblies familiar to those in the art. It is appreciated, however, that other known selector mechanisms could be likewise employed while achieving at least some of the advantages of the instant invention. In addition, it is understood that the input selectors may be arranged in many alternate configurations relative to displays 60, 222 without departing from the scope of the present invention. It is further recognized that the benefits of the invention equally accrue to control panels having greater or fewer numbers of input selectors than those represented in FIG. 4.

Having now described the invention in an exemplary context of a washing machine, it is believed that those in the art could readily adapt the teaching of the above description with appropriate modification for use in another laundry appliance, such as a clothes dyer, wherein the advantages set forth above in selecting desired machine cycle features and parameters in a straightforward fashion are equally applicable. As the construction and operation of clothes dryers is well known, it is believed that the methodology of the above-described control system could be implemented in an alternative laundry appliance without further explanation.

While the invention has been described in terms of various specific embodiments, those skilled in the art will recognize that the invention can be practiced with modification within the spirit and scope of the claims.

The invention claimed is:

1. A control panel for a laundry appliance, said control panel comprising:

a cycle type section comprising a reconfigurable display and a first set of input selectors associated with said reconfigurable display, said input selectors configured to select a menu option presented on said reconfigurable display; and a cycle parameter and option section comprising a plurality of graphical icon displays, each said graphical icon display including at least one of a plurality of graphical icons, each said graphical icon representative of a corresponding selected laundry cycle parameter, each said graphical icon display being a separate display than said reconfigurable display, said cycle parameter and option section configured to display a preset cycle parameter by changing an appearance of at least one of said graphical icons based on a selected menu option.

2. A control panel in accordance with claim 1 wherein at least one of said plurality of graphical icons is segmented to indicate a parameter setting.

3. A control panel in accordance with claim 1 further comprising a custom cycle input selector for recalling a user-created laundry cycle.

4. A control panel in accordance with claim 1 wherein said laundry appliance comprises a washing machine.

5. A control system for a laundry appliance, said control system comprising:

a microcomputer; and a control panel coupled to said microcomputer for receiving user input of laundry cycle selections, said control panel comprising:

a cycle type section comprising a reconfigurable display, said microcomputer programmed to generate selection menus on said reconfigurable display, said cycle type section further comprising a first set of input selectors associated with said reconfigurable display, each said selection menu comprising a plurality of menu options located adjacent a respective one of said first set of input selectors; and a cycle parameter and option section comprising a plurality of graphical icon displays, each said graphical icon display including at least one of a plurality of graphical icons, each said graphical icon representative of a laundry cycle parameter and configured to change an appearance thereof, thereby indicating a setting of a laundry cycle parameter, each said graphical icon display being a separate display than said reconfigurable display, said cycle parameter and option section configured to display a preset cycle parameter by changing an appearance of at least one of said graphical icons based on a selected menu option.

6. A control system in accordance with claim 5 wherein said cycle type section comprises a second set of input selectors, at least one input selector of said second set of input selectors having an associated selection menu, said microcomputer programmed to present said selection menu on said reconfigurable display when said at least one input selector is actuated by a user.

7. A control system in accordance with claim 5 wherein said laundry appliance comprises a washing machine, said at least one segmented graphical icon comprising at least one of a load size icon, a soil level icon, a wash temperature icon, and a spin speed icon.

8. A control system in accordance with claim 5 wherein said control panel further comprises at least one custom cycle key for recalling a user-created laundry cycle.

9. A laundry appliance comprising:

a cabinet comprising a backsplash;

a microcomputer; and a control panel coupled to said microcomputer, said control panel comprising:

a reconfigurable display;

a first set of input selectors associated with said reconfigurable display, said first set of input selectors configured to select a menu option presented on said reconfigurable display; and a plurality of graphical icon displays, each said graphical icon display including at least one of a plurality of graphical icons, each of said graphical icons representative of a laundry cycle parameter and configured to indicate selected laundry cycle parameters, each said graphical icon display being a separate display than said reconfigurable display, each of said graphical icon display configured to display a preset cycle parameter by changing an appearance of at least one of said graphical icons based on a selected menu option, said microcomputer programmed to change an appearance of said graphical icons as laundry cycle parameters are changed.

10. A laundry appliance in accordance with claim 9 wherein said graphical icons are segmented, said microcomputer programmed to change an appearance of said segments as laundry cycle parameters are changed.

11. A laundry appliance in accordance with claim 10 wherein said laundry appliance comprises a washing machine, said graphical icons comprising at least a load size icon, a soil level icon, a wash temperature icon, and a spin speed icon.

12. A laundry appliance in accordance with claim 9, said control panel further comprising a time display separate from said graphical icons.

13. A method of interfacing user input to a laundry appliance including a microcomputer coupled to a control panel interface, the control panel interface including at least one wash cycle type input selector, a cycle type section comprising a reconfigurable display and a first set of input selectors associated with the reconfigurable display, the first set of input selectors configured to select a menu option presented on the reconfigurable display; and a cycle parameter and option section comprising a plurality of graphical icon displays, each graphical icon display including at least one of a plurality of segmented graphical icons, each segmented graphical icon representative of a laundry cycle parameter, each graphical icon display being a separate display than the reconfigurable display, said method comprising:

displaying a menu selection screen on the reconfigurable display in response to actuation of at least one of the wash cycle type input selectors;

accepting a selection from the menu selection screen in response to actuation of one of the input selectors associated with the reconfigurable display; and separately displaying selected parameter values corresponding to the menu selection in the graphical icon displays by changing an appearance of at least one segment of the segmented graphical icon based on the accepted selection from the menu selection screen.

14. A method in accordance with claim 13, each of the graphical icons associated with an input selector, said method further comprising:

accepting user adjustment of one of the parameters corresponding to one of the graphical icons; and changing the appearance of the graphical icon to reflect the changed setting.

15. A method in accordance with claim 14, the control panel including a custom cycle input selector, the processor coupled to a memory, the method further comprising:

saving a current set of wash cycle parameters in the memory for future recall when the custom cycle input selector is actuated.

16. A method in accordance with claim 13 wherein the laundry appliance is a washing machine, said displaying a menu selection screen comprising displaying a menu selection screen corresponding to a wash cycle type, and said displaying selected parameter values comprises displaying a load size parameter, a soil level parameter, a wash temperature parameter, and a spin speed parameter.

* * * * *